US005292118A

United States Patent [19]

Allen et al.

[11] Patent Number: 5,292,118

[45] Date of Patent: Mar. 8, 1994

[54] BASKETBALL BACKBOARD ELEVATOR SYSTEM

[75] Inventors: David A. Allen, Pewaukee; Joseph K. Bohrman, Eagle; James N. Fitzsimmons; Michael A. Niver, both of Waukesha, all of Wis.

[73] Assignee: Huffy Corporation, Waukesha, Wis.

[21] Appl. No.: 830,125

[22] Filed: Jan. 31, 1992

[51] Int. Cl.[5] ..... A63B 63/08

[52] U.S. Cl. ..... 273/1.5 R; 248/284; 403/93

[58] Field of Search ..... 273/1.5 R, 1.5 A; 248/281.1, 284; 403/91-103; 297/367, 368; 74/577 R, 577 S

[56] References Cited

U.S. PATENT DOCUMENTS

| | | | |
|---|---|---|---|
| 78,570 | 6/1868 | Bragg | 297/367 |
| 169,382 | 11/1875 | Starr . | |
| 171,746 | 1/1876 | Starr . | |
| 213,775 | 4/1879 | Redman et al. . | |
| 289,653 | 12/1883 | Haynes | 297/367 X |
| 325,551 | 9/1885 | Lukens . | |
| 446,464 | 2/1891 | Nittinger . | |
| 480,261 | 8/1892 | Herr . | |
| 482,207 | 9/1892 | Streeter . | |
| 806,790 | 12/1905 | Foersterling . | |
| 876,525 | 1/1908 | Chkhester | 297/367 |
| 1,050,672 | 1/1913 | Macintosh . | |
| 1,139,581 | 5/1915 | Riley . | |
| 2,313,188 | 8/1940 | Woodburn | 273/1.5 |
| 2,391,872 | 4/1943 | Berg | 155/80 |
| 2,557,604 | 6/1951 | Invidiato | 403/93 X |
| 2,784,770 | 3/1957 | Herr | 297/367 |
| 3,237,902 | 3/1966 | Hayashi | 248/585 |
| 3,352,580 | 11/1967 | Kurz et al. | 287/14 |
| 3,368,847 | 8/1966 | Langmead | 297/366 |
| 3,462,102 | 8/1969 | Rivers | 248/4 |
| 3,467,377 | 9/1969 | Miller et al. | 273/1.5 |
| 3,490,727 | 1/1970 | Miller | 248/313 |
| 3,586,324 | 6/1971 | Bearson | 273/1.5 |
| 3,614,099 | 10/1971 | Sarno | 273/1.5 |
| 3,765,676 | 10/1973 | Bearson et al. | 273/1.5 |
| 3,802,702 | 4/1974 | Pulley | 273/1.5 |
| 4,145,044 | 3/1979 | Wilson et al. | 273/1.5 |
| 4,151,989 | 5/1979 | Dittrich | 273/1.5 |
| 4,311,338 | 1/1982 | Moorhouse | 297/411 |
| 4,330,101 | 5/1982 | Andersen | 248/284 |
| 4,395,040 | 7/1983 | White | 273/1.5 |
| 4,412,679 | 11/1983 | Mahoney et al. | 273/1.5 |
| 4,465,277 | 8/1984 | Dittrich | 273/1.5 |
| 4,640,549 | 2/1987 | Yokota | 297/410 |
| 4,684,129 | 8/1987 | Andersen et al. | 273/1.5 |
| 4,770,463 | 9/1988 | Nishino | 297/367 |
| 4,781,375 | 11/1988 | Nye | 273/1.5 |
| 4,798,381 | 1/1989 | Dadbeh | 273/1.5 |
| 4,805,904 | 2/1989 | Nye | 273/1.5 |
| 4,828,323 | 5/1989 | Brodersen et al. | 297/417 |
| 4,881,734 | 11/1989 | Nye | 273/1.5 |

FOREIGN PATENT DOCUMENTS 908055 10/1962 United Kingdom .

OTHER PUBLICATIONS

Wilson Adjustable Backstop Support, Backboard & Goal Kit Instruction Manual Mar. 1990.

*Primary Examiner*—Paul E. Shapiro

*Attorney, Agent, or Firm*—Michael, Best & Friedrich

[57] ABSTRACT

An elevator system for a basketball backboard comprising, in combination, a parallelogram frame and a backboard connected to the frame. A ratchet and pawl arrangement is connected between one of the arms and one of the vertical surfaces of the parallelogram frame so that a first vertical surface is freely movable upward relative to a second vertical surface and is held in a selected vertical position when the vertical lifting force applied to the first vertical surface is removed. The ratchet includes a plurality of ratchet teeth connected to and movable with one arm relative to the first vertical surface. The pawl is pivotally connected to the first vertical surface and disposed for engagement with the ratchet teeth to hold the first vertical panel in a selected vertical position when the vertical lifting force is removed. Also provided is a structure for biasing the pawl toward selective engagement with the ratchet teeth, the engagement depending upon the vertical position of the first vertical surface relative to the second vertical surface. A bell crank lever is pivotally connected to the first vertical surface and operatively associated with the ratchet and pawl arrangement, with a structure for connecting the bell crank lever to the pawl that is responsive to pivotal movement of the bell crank to move the pawl out of engagement with the ratchet teeth.

10 Claims, 2 Drawing Sheets

BASKETBALL BACKBOARD ELEVATOR SYSTEM

BACKGROUND OF THE INVENTION

This invention relates to basketball backboard support arrangements and, more particularly, to such arrangements as will permit adjustment of the vertical height of the backboard and attached goal.

The desirability of having an adjustable basketball backboard is well recognized. Numerous constructions have been proposed for accomplishing incremental adjustment of the vertical height of the backboard and attached goal. Such arrangements have incorporated parallelogram type support frames capable of permitting vertical movement of the backboard while maintaining a parallel relationship between the backboard and the particular support surface to which it is attached. In addition, various releasable locking arrangements have been proposed for holding the backboard at a desired height and alternatively allowing the backboard to be lowered to a different position. Such selective locking arrangements have been used in combination with parallelogram type frame supports as well as other types of backboard supports.

For the most part, these prior art arrangements have been relatively complex, meaning they are relatively involved and expensive to manufacture as well as difficult to manipulate after installation and in use.

Among the general objects of this invention are to provide a simplified and yet effective basketball backboard support.

A further object of this invention is to provide such a basketball support which permits incremental height adjustment of the goal with a simplified frame and selective height locking arrangement.

Yet another general object of this invention is to provide an effective locking arrangement for establishing a desired basketball goal height and yet one which is relatively simple to operate both when raising and lowering the goal.

A more specific object of this invention is to provide a combination height adjustable backboard support and locking arrangement therefor, which combination permits upward adjustment of the backboard and release for downward movement of the backboard through basically a unitary readily manipulable releasable locking mechanism.

SUMMARY OF THE INVENTION

The invention provides an elevator system for a basketball backboard having a parallelogram frame and a backboard connected to the frame. The frame has first and second vertical, relatively parallel surfaces, upper and lower parallel arms disposed one above the other and extending between the first and second surfaces, and a pivotal connection of the arms to both of the vertical surfaces so that the first vertical surface is supported on the arms for vertical movement relative to the second vertical surface while maintaining the parallel relation between the first and second surfaces. A ratchet and pawl arrangement is connected between the arms and the vertical surfaces so that one vertical surface is freely movable upward relative to the other and can be held at a selected height when the vertical lifting force applied is removed. The ratchet is connected to and movable with the one arm and the pawl is pivotally connected to the first vertical surface for engagement with the ratchet teeth to hold the first vertical panel in a selected vertical position. Also provided is means for biasing the pawl toward selective engagement with the ratchet teeth, the engagement depending upon the vertical position of the first vertical surface. A bell crank lever is pivotally connected to the first vertical surface and operatively associated with the ratchet and pawl arrangement much that pivotal movement of the bell crank moves the pawl out of engagement with the ratchet teeth. Vertical manipulating means is engageable with the first vertical surface for applying the vertical lifting force and further for engaging the bell crank and pivoting the bell crank lever and the pawl against the bias to disengage the pawl from the ratchet to permit lowering of the first vertical surface.

In another embodiment the invention provides an elevator system for a basketball backboard which includes a frame having means defining first and second relatively spaced parallel, vertical surfaces. The frame has means defining support arms, relatively spaced one above the other, and pivotally connected between the first and second surfaces so that the vertical surfaces are connected on the arms for relative vertical movement while maintaining the parallel relation between the first and second surfaces. Means defining a ratchet and pawl arrangement are connected between one of the arms and one of the vertical surfaces so that the one vertical surface is freely movable upward relative to the second vertical surface, and can be held by the ratchet and pawl in a selected vertical position when the vertical lifting force applied to the first vertical surface is removed. The ratchet and pawl are pivotally connected to one vertical surface with one or the other of the ratchet and pawl being pivotally connected to one of the support arms. Also included are means biasing the pawl toward engagement with the ratchet, the ratchet being freely movable relative to the pawl upon upward movement of one vertical surface and the pawl, then, engageable with the ratchet to hold the one support arm against pivotal movement and correspondingly the one vertical surface against downward movement. Separate means are provided for selectively engaging the pawl and for moving the pawl out of engagement with the ratchet so that the one vertical surface is released for downward movement, whereby the one vertical surface is freely movable in an upward direction while maintaining a parallel relation with the other vertical surface, is held in a selected vertical position by the ratchet and pawl arrangement, and is released for downward movement when the pawl is disengaged from the ratchet.

More generally, the frame supports a backboard and is attached to a support structure. The backboard is connected for up and down movement while maintaining the backboard in a preselected vertical orientation. Releasable locking means is connected to the frame and allows free upward movement of the backboard and releasably locks the backboard and frame means at a desired vertical height. Means on the frame means adjacent the releasable locking means is engageable by vertical manipulating means for applying a vertical lifting force to the backboard. The vertical manipulating means is connectable with the releasable locking means and the vertical manipulating means is operative to release the locking means so that the same manipulating means can be used to raise the backboard and to release the locking means to lower the backboard.

Other features and advantages of the invention will become apparent to those of ordinary skill in the art upon review of the following detailed description, claims, and drawings.

Figure 1:
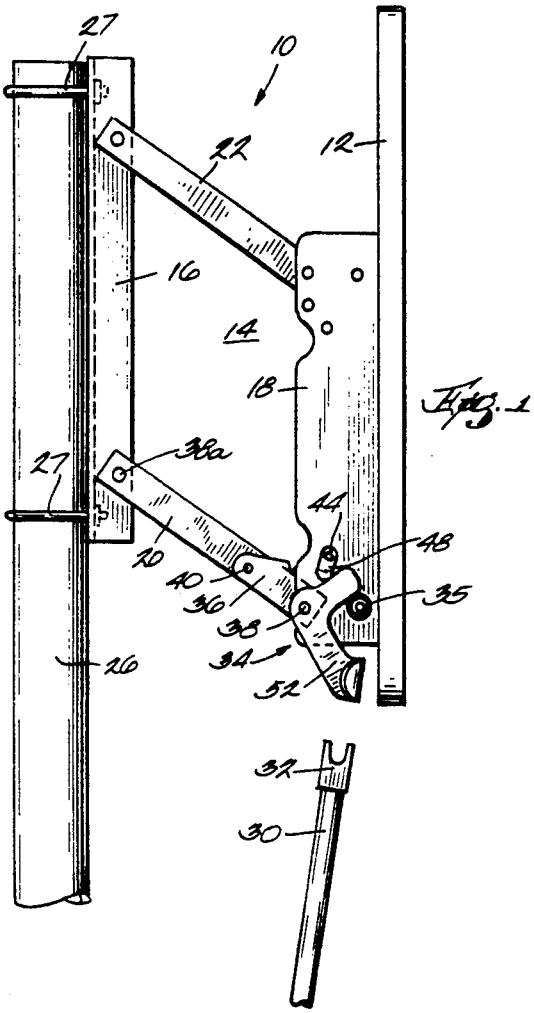
FIG. 1 is a side elevation showing a basketball backboard attached to a pole through a parallelogram structure.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

An elevator system embodying the invention, which is used in adjusting the height of a basketball backboard and goal (not shown), is shown in FIGS. 1-8.

With reference to FIG. 1, the elevator system 10 comprises a basketball backboard 12 mounted to an adjustable frame 14 which is generally in the form of a parallelogram. The frame 14 comprises vertical and horizontal extensions or supports. More specifically, these are the back vertical members or brackets 16, forward vertical members or brackets 18 and 19, lower horizontal arms 20 and 21 and upper horizontal arms 22. Only one arm 22 is illustrated in the drawings, it being appreciated that there are two, one positioned over each of the arms 18 and 19. Likewise, only one vertical bracket 16 is illustrated in the drawings, it being understood that there are two, one bracket attached to the back of arm 20, and the other attached to the back of arm 21. The backboard 12 is attached, such as through bolts 24 (FIG. 8), to the forward vertical brackets 18 and 19 of the parallelogram frame 14. The back vertical brackets 16 are secured to a support surface 26, such as a pole or other fixed object. In the illustrated embodiment they are secured to a pole support surface 26 by conventional U-shaped brackets 27 (FIG. 1).

The front brackets 18 and 19 have turned-in forward surfaces, or legs 28 and 29. The surfaces of the front, turned-in legs 28 and 29 of the brackets 18 and 19 are in a common vertical plane, thus the front brackets 18 and 19 can be viewed as defining a generally vertical backboard support surface. Similarly, the rear brackets 16 can be viewed as defining a generally vertical attachment surface. Arms 20, 21 and 22 are pivotally attached to brackets 16, 18 and 19. As a result, in parallelogram fashion, backboard 12, with brackets 18 and 19 can be moved vertically relative to support surface 26 but while maintaining the forward vertical surface (brackets 18 and 19) to which the backboard is attached in parallel relationship with the rear vertical surface (brackets 16).

The backboard elevation is adjusted through the use of an elongated pole 30. The end of pole 30 has an open ended, U-shaped tip 32 which is engageable with parallelogram frame 14 to raise the background. This structure and operation will be described more completely hereinafter.

A releasable locking mechanism in the form of a ratchet and pawl arrangement 34 is also provided, for holding the backboard in any selected vertical position. Again, the structure and operation of the ratchet and pawl will be described more completely hereinafter.

Engagement of the pole with the frame is achieved through post 35 extending laterally from bracket 18 in the area, i.e., adjacent to, the locking mechanism.

Figure 2:
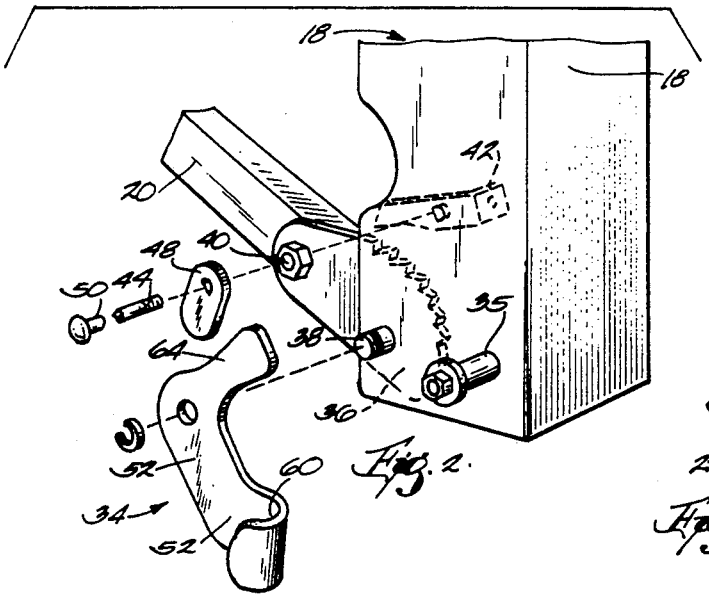
FIG. 2 is a perspective, partially exploded view of the ratchet and pawl arrangement of the elevator system.

FIG. 2 shows the various components of the ratchet and pawl 34. The components are illustrated in perspective and partially exploded to more distinctly show the working relationship of the components. A similar ratchet and pawl is associated with arm 21, but for convenience only one arrangement will be described in detail, it being appreciated that the two are identical. A ratchet 36 is shown as attached to a lower arm 20 of the parallelogram 14. The lower arm 20 and the ratchet 36 are mounted for rotation about a pivot pin 38 supported on the vertical bracket 18 (with a pivot pin 38*a* on bracket 19 performing a similar function for lower arm 21 and a ratchet 36*a*). The ratchet 36 is attached to and movable with the lower arm 20 by an attachment 40. When the lower extension arms 20 and 21 pivot about pivots 38 and 38*a* to the back brackets 16, the ratchets 36 and 36*a* move with them. Upper arms 22 move correspondingly.

A pawl 42 is supported from bracket 18 by a shaft 44, and is adjacent ratchet 36 to selectively engage and lock the parallelogram frame 14 in a desired fixed position. A spring 46 (FIGS. 3-5 and 7) biases the pawl 42 and the shaft 44 in a counterclockwise direction such that the pawl 42 is generally urged into engagement with one of the teeth on the ratchet 36. The shaft 44 also carries a release link 48. Pawl 42 and release link 48 are connected for rotation with shaft 44 by means of a flattened portion on shaft 44 engaged in a complementary shaped opening in pawl 12 and link 48. In FIGS. 3-5 and 7, the head 50 of pin 44 is cut away to better depict the connection. A nut 50*a* threads onto the opposite end of shaft 44 to complete the connection.

The locking mechanism also includes a bell crank lever 52, which is pivotally mounted on pivot 38 together with arm 20 and ratchet 36. The bell crank lever 52 includes angularly related arms 54 and 56. The arm 54 is positioned adjacent link 48 so that as the arm 56 rotates in counterclockwise direction the arm 54 engages link 48, rotating it and pawl 42 clockwise against the bias of spring 46. This movement releases the pawl 42 from the teeth of the ratchet 36 to accommodate up or down movement of the backboard.

Figure 3:
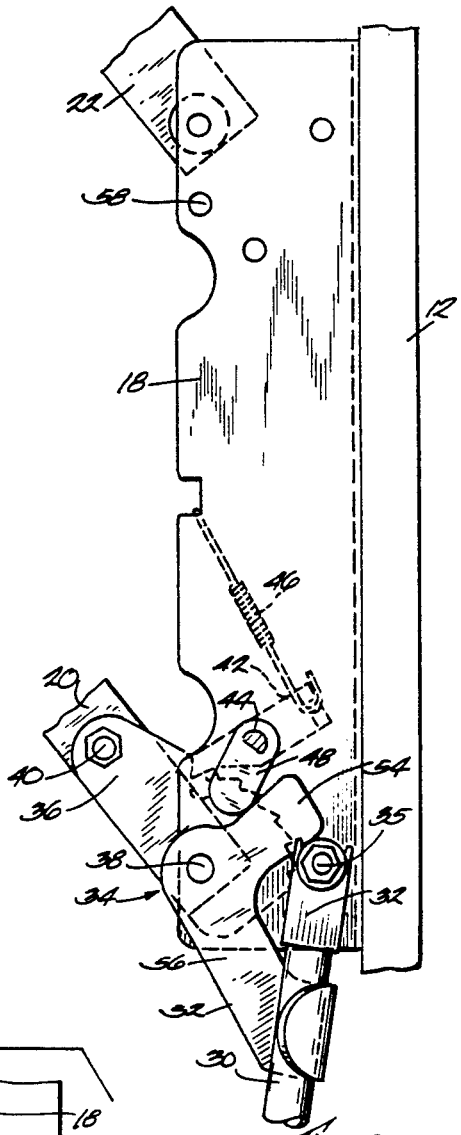
FIG. 3 is an enlarged side elevation of the backboard portion of the support frame, and showing the elevator system engaged in its lowest position.
Figure 4:
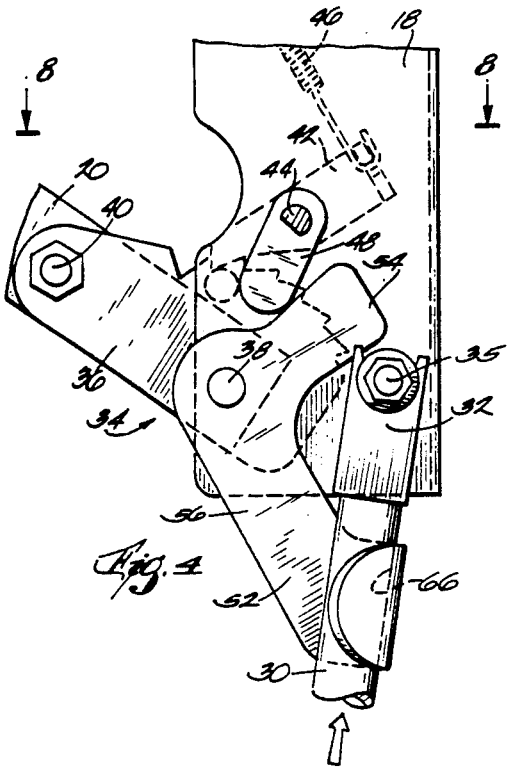
FIG. 4 is an enlarged side elevation of the ratchet and pawl arrangement engaged in the next highest position from FIG. 3.
Figure 5:
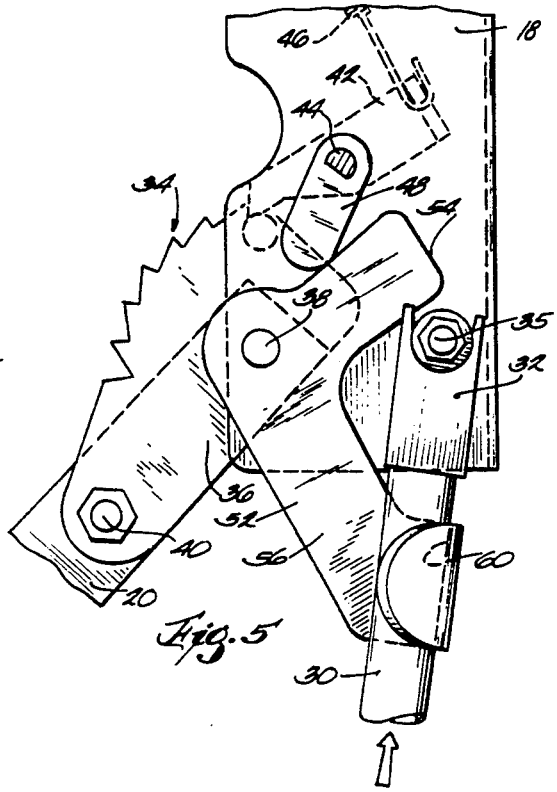
FIG. 5 is a side elevation of the ratchet and pawl arrangement engaged in its highest position.
Figure 7:
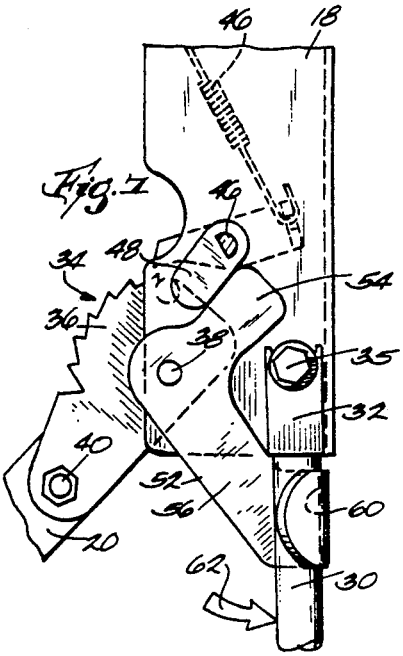
FIG. 7 is a side elevation of the ratchet and pawl arrangement where the pawl has been pivoted to its release position to permit lowering the backboard.

FIG. 3 shows the ratchet and pawl 34 engaged when the parallelogram frame 14, and hence the backboard, is in its lowermost position. FIGS. 4 and 5 show the ratchet and pawl engaged in intermediate and uppermost positions. In these conditions, the backboard is held against downward movement.

The overall operation of the elevator system will be described in relation to FIGS. 3-5 and 7.

Figure 6:
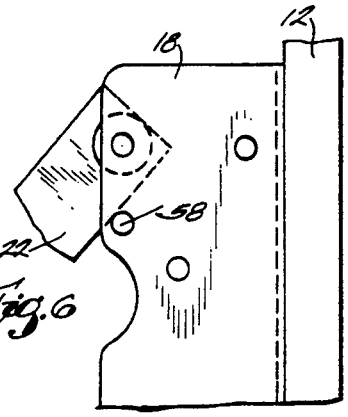
FIG. 6 is a side elevation of the upper portion of the backboard and elevator system engaged in the highest position and showing an upper stop mechanism.

When it is desired to raise the backboard 1, tip 32 of pole 30 is pressed into contact with post 35. When pole 30 is moved upward against post 35, vertical brackets 18 and 19 move upward with the upper and lower arms 20, 21 and 22 pivoting to accommodate that movement. During this upward movement, ratchet 36 rotates about the pivot 38 with its teeth passing under pawl 42, the pawl sequentially being positioned to engage a particular ratchet tooth depending upon at which point the upward pressure on post 35 is removed. The backboard 12 can be incrementally raised in this manner, one tooth at a time if desired, until the pawl 42 reaches the last tooth of the ratchet 36 as shown in FIG. 5. As seen in FIG. 6, stop 58 on the upper portion of the vertical bracket 18 limits the upward movement of the backboard 12. More particularly, the limit on upward movement is such that pawl 42 can be raised slightly above the last tooth of the ratchet 36 so that the pawl can be selectively engaged with and disengaged from the last ratchet tooth.

At this point, it will be noted that pole 30 is cradled in a convex projection 60 on the end of arm 56. When it is desired to lower the backboard 12, the pole 30 is moved vertically upward to release the pawl and then pole 30 is moved in a counterclockwise direction about post 35, as indicated by the arrow 62 (FIG. 7), until the pole 30 is in a vertical position. When the pole 30 is moved to a vertical position, that movement is transmitted through projection 60 of the bell crank lever 52 to arm 54 of the bell crank lever and thus to link 48. Link 48 transmits movement through shaft 44 to pawl 42. That is, release link 48 rotates in a clockwise direction. Shaft 44 also rotates in a clockwise direction, then, and the pawl 42 rotates with the shaft 44, to maintain the pawl disengaged from the teeth of ratchet 36. Thus, a backboard 12 mounted on the parallelogram frame 14 may now be lowered simply by lowering the pole 30 while maintaining its vertical orientation, so that the ratchet and pawl remain disengaged. It will be noted that spring 46, in addition to biasing pawl 42 into engagement with the ratchet 36, also biases link 48 into engagement with arm 54 of bell crank lever 52.

When the pole 30 is rotated opposite to the direction of arrow 62, the spring 46 returns the pawl 42 back into a locking position, such as is shown in FIGS. 3-5. Of course, any rotational movement of the pawl 42 will translate into similar movement of the release link 48, and thereby act to urge the bell crank lever 52 back to its rest position along with the pole 30. In this manner, any locking position of locking member 34 can be chosen while lowering the backboard elevation. In other words, whenever the pressure of pole 30 on engagement surface 60 is released, or the pole 30 is turned clockwise, the engagement end of the pawl 42 can be lowered counterclockwise to engage a tooth of the ratchet 36. The tooth engaged will depend on the rotational position of the ratchet 36 about the pivot 38, which will vary with the backboard elevation, and that elevation will be maintained by the pawl 42 engaging the tooth of the ratchet 36.

It will be noted that the combination of the ratchet and pawl 34, bell crank lever 52 and post 35 are all located in the same area on the frame, and particularly in the area of one of the pivot connections of the support arms with the vertical support surface. With this arrangement, the same mechanism for raising and lowering the backboard (pole 30) can be used to operate the releasable locking mechanism. The system overall is, thus, a simple mechanism to fabricate and assemble and one which is very simple to operate.

Figure 8:
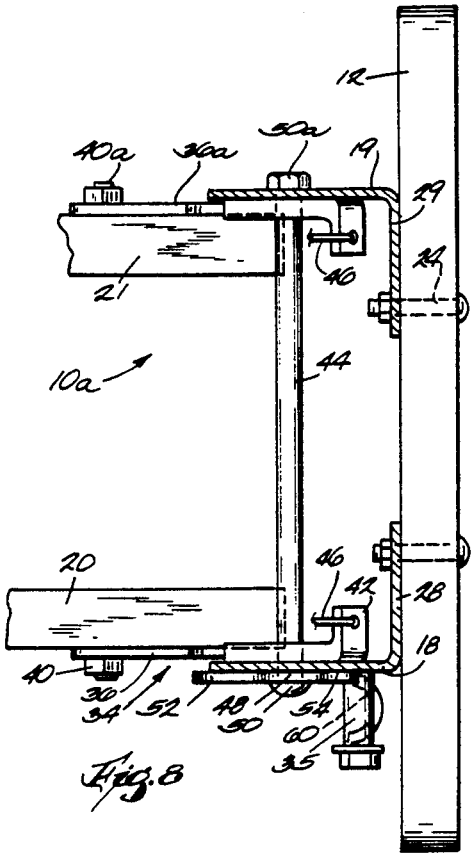
FIG. 8 is a sectional view of the elevator system taken along line 8—8 of FIG. 4.

FIG. 8 shows a top sectional view of the elevator system 10, utilizing a releasable locking mechanism associated with both vertical brackets 18 and 19 and connected on a common shaft 44 which traverses the width of the parallelogram frame 14, with bolt 50*a* securing the opposite end of shaft 44. The second ratchet 36*a* is illustrated on an opposite horizontal support arm 21 and the second pawl 42*a* is attached to an opposite vertical bracket 19. The additional ratchet and pawl arrangement, when used, provides added support and safety to the parallelogram frame 14, and balances the forces holding the backboard 12 in an elevated position. When pole 30 is rotated against the projection 60 of the lever 52, the lever rotates release links at both support arms 20 and 21 through the common shaft 44. Thus, rotation of the common shaft 44 rotates both of the pawls 42 and 42*a* to their disengaged positions when the backboard 12 is to be lowered. When the pressure of pole 30 on lever 52 is removed, i.e., the pole 30 is rotated clockwise, the springs 46 and 46*a* return their respective pawls 42 and 42*a* in a counterclockwise direction. Only one spring can be provided, if desired, as rotational movement of one pawl is always translated to the other through the common shaft 44, but two springs make for more reliable operation. In either case, the common shaft 44 is rotated in a counterclockwise direction in release, and thereby will necessarily cause both pawls to move into engagement. The pawls 42 and 42*a* are thus simultaneously urged back into engagement with teeth on ratchets 36 and 36*a*, respectively, to lock into position. Release link 48 is on the same common shaft 44, and will be moved as well, back into engagement with the arm 54 of bell crank lever 52, causing the release link 48 and the bell crank lever 52 to return to their rest positions.

Although one embodiment of the present invention has been illustrated and described, it will be apparent to those skilled in the art that various changes and modifications may be made therein without departing from the spirit of the invention or from the scope of the appended claims.

We claim:

1. An elevator system for a basketball backboard comprising, in combination, a parallelogram frame and a backboard connected to said frame, said parallelogram frame including, first and second vertical, relatively parallel surfaces, upper and lower arms disposed in parallel relation one above the other and extending between said first and second surfaces, and means for pivotally connecting said arms to both of said vertical surfaces so that said first vertical surface is supported on said arms for vertical movement relative to said second vertical surface while maintaining said parallel relation between said first and second surfaces, a ratchet and pawl arrangement connected between one of said arms and one of said vertical surfaces so that said first vertical surface is freely movable upward relative to said second vertical surface in response to a vertical lifting force applied to said first vertical surface and is held in a selected vertical position when the vertical lifting force applied to said first vertical surface is removed, said ratchet including a plurality of ratchet teeth connected to and movable with said one arm relative to said first vertical surface, said pawl being pivotally connected to said first vertical surface and disposed for engagement with said ratchet teeth to hold said first vertical surface in a selected vertical position when said vertical lifting force is removed, means biasing said pawl toward selective engagement with said ratchet teeth depending upon the vertical position of said first vertical surface relative to said second vertical surface, a bell crank lever pivotally connected to said first vertical surface and operatively associated with said ratchet and pawl arrangement, means for connecting said bell crank lever to said pawl, pivotal movement of said bell crank operative to move said pawl out of engagement with said ratchet teeth, and vertical manipulating means simultaneously engageable with said first vertical surface and with said bell crank for pivoting said bell crank lever and said pawl against said bias to positively disengage said pawl from said ratchet to permit lowering of said first vertical surface and also for applying said vertical lifting force to raise said first vertical surface without engaging said bell crank to positively disengage said pawl from said ratchet.

2. An elevator system for a basketball backboard comprising, in combination, a frame including means defining first and second relatively spaced parallel, vertical surfaces, said frame further including means defining support arms relatively spaced one above the other pivotally connected between said first and second surfaces so that said vertical surfaces are connected on said arms for relative vertical movement while maintaining said parallel relation between said first and second surfaces, means for adjusting the vertical height of said first vertical surface defining ratchet and pawl members connected between one of said arms and said first vertical surface so that said first vertical surface is freely movable upward relative to said second vertical surface in response to a vertical lifting force applied to said first vertical surface and is held in a selected vertical position when the vertical lifting force applied to said first vertical surface is removed, said pawl member being pivotally connected to said first vertical surface and said ratchet member being connected to one of said support arms and pivotally connected to said first vertical surface, means biasing said pawl toward engagement with said ratchet, said ratchet being freely movable relative to said pawl upon upward movement of said first vertical surface and said pawl engageable with said ratchet to hold said one support arm against pivotal movement and correspondingly said first vertical surface against downward movement, means selectively engageable with said pawl for moving said pawl out of engagement with said ratchet so that said first vertical surface is released for downward movement, a contact point on said first vertical surface, and vertical manipulating means for applying said vertical lifting force to said contact point so that said first vertical surface is freely movable in an upward direction without disengagement of said pawl from said ratchet while maintaining a parallel relation with said second vertical surface, is held in a selected vertical position by said ratchet and pawl arrangement when said vertical lifting force is removed, and is released for downward movement when said pawl is disengaged from said ratchet by contact between said vertical manipulating means and said pawl engagement means and while said vertical manipulating means remains engaged with said contact point.

3. The elevator system of claim 2 wherein said means selectively engageable with said pawl comprises bell crank means pivotally connected to one of said first vertical surface and said one support arm adjacent said ratchet and pawl arrangement for moving said pawl away from said ratchet upon pivotal movement of said bell crank to release said one vertical surface for downward movement.

4. The elevator system of claim 3 wherein said vertical manipulating means comprises a pole, and further includes projection means on said bell crank means disposed below said contact point and generally in vertical alignment with said contact point for engagement by said pole, whereby said pole when engaged with said contact point to apply an upward force on said contact point is also selectively engageable with said projection means on said bell crank means to pivot said bell crank means into engagement with and move said pawl away from said ratchet.

5. An elevator system for a basketball backboard comprising, in combination, a parallelogram frame and a backboard connected to said frame, said parallelogram frame including first and second vertical, relatively parallel surfaces, upper and lower arms disposed in parallel relation one above the other and extending between said first and second surfaces, and means for pivotally connecting said arms to both of said vertical surfaces so that said first vertical surface is supported on said arms for vertical movement relative to said second vertical surface while maintaining said parallel relation between said first and second surfaces, a ratchet and pawl arrangement connected between one of said arms and one of said vertical surfaces so that said first vertical surface is freely movable upward relative to said second vertical surface in response to a vertical lifting force applied to said first vertical surface and is held in a selected vertical position when the vertical lifting force applied to said first vertical surface is removed, said ratchet including a plurality of ratchet teeth and connected to and movable with said one arm for pivotal movement relative to said first vertical surface, said pawl being pivotally connected to said first vertical surface and disposed for engagement with said ratchet teeth to hold said first vertical surface in a selected vertical position when said vertical lifting force is removed, means biasing said pawl toward selective engagement with said ratchet teeth depending upon the vertical position of said first vertical surface relative to said second vertical surface, a bell crank lever pivotally connected to said first vertical surface and operatively associated with said ratchet and pawl arrangement, means for connecting said bell crank lever to said pawl, pivotal movement of said bell crank operative to move said pawl out of engagement with said ratchet teeth, a contact point on said first vertical surface for receiving said vertical lifting force, and vertical manipulating means for applying said vertical lifting force at said contact point without positive disengagement of said pawl from said ratchet and for causing pivotal movement of said bell crank to positively disengage said pawl from said ratchet while said vertical manipulating means remains in engagement with said contact point.

6. The elevator system of claim 5 wherein said bell crank lever is pivotally connected relative to said pawl, said contact point comprises a first lateral projection on said first surface adjacent said ratchet and pawl arrangement, and said bell crank lever comprises a lateral projection on said bell crank lever and located below said first lateral projection, whereby said vertical manipulating means comprises an implement engageable with said first lateral projection to apply said vertical lifting force to said first surface and which is also engageable with said lateral projection on said bell crank to pivot said bell crank and move said pawl away from said ratchet to release said first surface for downward movement.

7. The elevator system of claim 6 wherein the pivot connection of said bell crank lever is common with the pivot connection of said one support arm to said first vertical surface and to the connection of said ratchet.

8. The elevator system of claim 7 wherein said upper and lower arms comprise two pairs of horizontally spaced arms and wherein each pair of said arms are spaced one above the other, and said elevator system further includes a ratchet and pawl arrangement as defined in claim 7 connected between one of the arms of each pair and said vertical support surface.

9. The elevator system of claim 8 wherein each of said pawls is pivotally connected to said first surface, wherein each of said ratchets is connected to said one arm in each pair of arms, wherein said bell crank lever is pivotally connected relative to said pawls, including a first lateral projection on said first surface adjacent one of said ratchet and pawl arrangements, and a lateral projection on said bell crank lever and located below said first lateral projection, whereby an implement engageable with said first lateral projection to apply a vertical lifting force to said first surface is also simultaneously engageable with lateral projection on said bell crank to pivot said bell crank and move each of said pawls away from said ratchets to release said first surface for downward movement.

10. The elevator system of claim 9 wherein the pivot connection of said bell crank lever between each one of said arms and said first vertical support surface is common with the pivot connection of said one support arm to said first vertical surface and to the pivot connection of said ratchet.

* * * * *